US009140263B2

(12) United States Patent
Horng

(10) Patent No.: US 9,140,263 B2
(45) Date of Patent: Sep. 22, 2015

(54) ADVECTION FANS

(75) Inventor: Alex Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 459 days.

(21) Appl. No.: 13/481,939

(22) Filed: May 28, 2012

(65) Prior Publication Data

US 2013/0171014 A1 Jul. 4, 2013

(30) Foreign Application Priority Data

Jan. 4, 2012 (TW) ..... 101100345 A

(51) Int. Cl.

| | |
|---|---|
| ***F04D 25/06*** | (2006.01) |
| ***F04D 17/04*** | (2006.01) |
| ***F04D 29/42*** | (2006.01) |
| *F04D 29/40* | (2006.01) |
| *F04D 29/60* | (2006.01) |

(52) U.S. Cl.

CPC ..... *F04D 17/04* (2013.01); *F04D 25/0653* (2013.01); *F04D 29/4226* (2013.01); *F04D 25/06* (2013.01); *F04D 25/064* (2013.01); *F04D 25/0606* (2013.01); *F04D 25/0646* (2013.01); *F04D 29/403* (2013.01); *F04D 29/602* (2013.01)

(58) Field of Classification Search

CPC ..... F04D 17/04; F04D 25/06; F04D 25/064; F04D 25/0606; F04D 25/0646; F04D 25/0653; F04D 29/403; F04D 29/4226; F04D 29/602

USPC ..... 417/423.1, 423.7, 423.12, 423.14, 161, 417/201, 354, 352, 353; 310/156.32–156.37, 268, 71, 67

See application file for complete search history.

(56) References Cited

U.S. PATENT DOCUMENTS 4,885,488 A * 12/1989 Cox ..... 310/68 R
6,979,169 B2 * 12/2005 Penlesky et al. ..... 415/1

(Continued)

FOREIGN PATENT DOCUMENTS

CN 101451536 6/2009
CN 201486892 5/2010

(Continued)

*Primary Examiner* — Devon Kramer
*Assistant Examiner* — Stephen Mick
(74) *Attorney, Agent, or Firm* — Alan D. Kamrath; Kamrath IP Lawfirm, P.A.

(57) ABSTRACT

An advection fan includes a housing having a metal housing base and a closure member. A lateral wall is arranged between the metal housing base and the closure member and includes an air inlet and an air outlet. A horizontal air passage is defined between the metal housing base and the closure member. The metal housing base includes an engagement section. A stator includes a coil unit embedded in or abutting and attached to the engagement section of the metal housing base. The coil unit abuts the engagement face of the metal housing base. The coil unit includes a substrate and at least one coil formed on a surface of the substrate by a printing circuit or electroforming process. An impeller is rotatably coupled to the shaft tube of the stator. A gap is formed between the impeller and the coil unit of the stator.

34 Claims, 10 Drawing Sheets

(56) References Cited

U.S. PATENT DOCUMENTS

| | | | | |
|---|---|---|---|---|
| 7,011,504 | B2 * | 3/2006 | Seo et al. | 416/247 R |
| 7,416,388 | B2 | 8/2008 | Huang et al. | |
| 2005/0214144 | A1 * | 9/2005 | Yoshida et al. | 417/423.14 |
| 2006/0245922 | A1 * | 11/2006 | Hsu et al. | 415/206 |
| 2007/0212219 | A1 * | 9/2007 | Teshima et al. | 415/206 |
| 2009/0168351 | A1 | 7/2009 | Chen et al. | |
| 2010/0303647 | A1 * | 12/2010 | Ida et al. | 417/352 |
| 2010/0316509 | A1 * | 12/2010 | Horng et al. | 417/352 |

FOREIGN PATENT DOCUMENTS

| | | |
|---|---|---|
| JP | 5493339 | 5/2014 |
| TW | 553323 U | 9/2003 |
| TW | M350746 | 2/2009 |

* cited by examiner

ADVECTION FANS

BACKGROUND OF THE INVENTION

1. Field of the Invention

The present invention relates to advection fans and, more particularly, to advection fans that allow air currents to enter and exit in a direction perpendicular to an axial direction.

2. Description of the Related Art

Conventional cooling fans generally include axial fans and blower fans. An axial fan generally includes an axial air inlet and an axial air outlet spaced in an axial direction. Air currents are guided into the axial air inlet and then exit from the axial air outlet to provide a cooling function. A blower fan generally includes an axial air inlet and a radial air outlet. Air currents are guided into the axial air inlet and then exit from the radial air outlet to provide the cooling function.

However, axial fans can only guide air currents to flow in the axial direction for cooling purposes. Namely, axial fans can not guide air currents to flow in the radial direction. Thus, the axial fans must be mounted on top of a heat source (such as on a top face of a central processing unit of a personal computer) when used in various electronic products, such that the overall axial height of the electronic products can not be reduced. Although blower fans can guide air currents to exit from the radial air outlet, the air currents must be guided into the blower fans via the axial air inlet. As a result, the blower fans are not suitable for electronic products (such as cell phones, personal digital assistants, etc,) that must guide the air currents in lateral direction into a lateral side of the electronic product.

Namely, axial fans and blower fans currently available in the market can not be applied in small electronic products having limited inner spaces.

Taiwan Patent Publication No. 553323 discloses an advection fan that guides air currents in and out in a radial direction. Such an advection fan is more suitable for small electronic products that guide the air currents into the lateral side.

FIG. 1 shows another advection fan 9 including a housing 91 and an impeller 92. The housing 91 includes an air passage 911 receiving a stator 93. The stator 93 includes a shaft seat 931, silicon steel plates 932 mounted around the shaft seat 931, coils 933, and insulating bobbins 934. The impeller 92 is rotatably coupled to the shaft seat 931. The stator 93 drives the impeller 92 to rotate to drive air currents to enter an end of the passage 911 and exit from the other end of the passage 911, providing a cooling function.

The advection fan 9 is used in small electronic products and is miniaturized in the volume and the axial height of the housing 91. However, the passage 911 must receive the stator 93 that includes the silicon steel plates 932, the coils 933, and the insulating bobbins 934 and, thus, occupies a considerable space in the passage 911. The air guiding space in the miniaturized housing 91 is insufficient for guiding air currents, leading to a significant decrease in the air output and the wind pressure. Furthermore, unnecessary noise could occur due to hindrance to the air currents by the silicon steel plates 932, the coils 933, and the insulating bobbins 934. Further, the housing 91 must include a predetermined axial height "H" to provide sufficient room for receiving the stator 93. As a result, the volume and the axial height "H" of the housing 91 for receiving the stator 93 can not be further reduced while assuring sufficient space for guiding air currents. Namely, development and research in miniaturization of the advection fan 9 of this type is impossible. Further, the impeller 92 mounted in the passage 911 must be in the form of a hub to receive the stator 93. Thus, the air currents are hindered by a large portion of the hub while flowing through the passage 911, causing turbulence and resulting in considerable insufficiency in the air output and the wind pressure, significantly and adversely affecting the overall cooling effect of the advection fan 9.

SUMMARY OF THE INVENTION

An objective of the present invention is to provide an advection fan in which the stator does not occupy much space of the advection fan, effectively increasing the air output and the wind pressure while reducing unnecessary noise.

Another objective of the present invention is to provide an advection fan that includes a housing having a reduced axial height, allowing development and research in miniaturization.

A further objective of the present invention is to provide an advection fan including an impeller that guides air currents in and out in a radial direction to reduce hindrance to the air currents by the stator, increasing the cooling effect.

The present invention fulfills the above objectives by providing, in a first aspect, an advection fan includes a housing having a metal housing base and a closure member. A lateral wall is arranged between the metal housing base and the closure member and includes an air inlet and an air outlet. A horizontal air passage is defined between the metal housing base and the closure member. The metal housing base includes an engagement section having a through-hole. A stator includes a shaft seat and a coil unit. The shaft seat integrally wraps the through-hole of the metal housing base. The shaft seat includes a compartment having a shaft coupling portion. The coil unit is embedded in the compartment. The coil unit includes a substrate having at least one coil unit formed on a surface of the substrate by a printing circuit or electroforming process. An impeller is rotatably coupled to the shaft coupling portion of the shaft seat of the stator. A gap is formed between the impeller and the coil unit of the stator.

In a second aspect, an advection fan includes a housing having a metal housing base and a closure member. A lateral wall is arranged between the metal housing base and the closure member and includes an air inlet and an air outlet. A horizontal air passage is defined between the metal housing base and the closure member. The metal housing base includes an engagement section having a recess. The recess includes a bottom having a fixing hole. A stator includes a shaft tube and a coil unit. The shaft tube is fixed in the fixing hole of the recess. The coil unit is embedded in the recess. The coil unit includes a substrate having at least one coil unit formed on a surface of the substrate by a printing circuit or electroforming process. An impeller is rotatably coupled to the shaft tube of the stator. A gap is formed between the impeller and the coil unit of the stator.

In a third aspect, an advection fan includes a housing having a metal housing base and a closure member. A lateral wall is arranged between the metal housing base and the closure member and includes an air inlet and an air outlet. A horizontal air passage is defined between the metal housing base and the closure member. The metal housing base includes an engagement section. The engagement section includes a shaft receiving hole and an engagement face surrounding the shaft receiving hole. A stator includes a shaft tube and a coil unit. The shaft tube is fixed in the shaft receiving hole. The coil unit abuts the engagement face of the metal housing base. The coil unit includes a substrate having at least one coil unit formed on a surface of the substrate by a printing circuit or electroforming process. An impeller is rotatably coupled to the shaft tube of the stator. A gap is formed between the impeller and the coil unit of the stator.

In a fourth aspect, an advection fan includes a housing having a metal housing base and a closure member. A lateral wall is arranged between the metal housing base and the closure member and includes an air inlet and an air outlet. A horizontal air passage is defined between the metal housing base and the closure member. The metal housing base includes an engagement section. A stator includes a coil unit embedded in or abutting and attached to the engagement section of the metal housing base. The coil unit abuts the engagement face of the metal housing base. The coil unit includes a substrate having at least one coil unit formed on a surface of the substrate by a printing circuit or electroforming process. An impeller is rotatably coupled to the shaft tube of the stator. A gap is formed between the impeller and the coil unit of the stator.

In an example, the impeller includes a metal impeller base, a shaft, and a plurality of vanes. The metal impeller base includes a permanent magnet facing the coil unit. The gap is an axial gap between the permanent magnet and the coil unit. The shaft is coupled to a central portion of the metal impeller base and rotatably coupled to the shaft coupling portion of the shaft seat. The plurality of vanes is engaged with the metal impeller base.

Each of the plurality of vanes includes a top edge in an axial direction of the shaft. The top edge of each of the plurality of vanes faces the closure member, with an axial height difference existing between the top edge of each of the plurality of vanes and the metal impeller base.

The plurality of vanes can be plastic vanes integrally formed with an outer periphery of the metal impeller base.

In an example, the metal housing base includes a wire hole. The at least one coil of the coil unit is electrically connected to a power cable. The power cable extends through the wire hole and is electrically connected to a driving circuit.

In another example, the metal housing base includes a wire hole. The at least one coil of the coil unit is electrically connected to a power cable. The lateral wall includes a receiving portion receiving a driving circuit. The power cable extends through the wire hole and extends along a bottom side of the housing into the receiving portion and is electrically connected to the driving circuit.

The receiving portion can be a cavity defined in the lateral wall.

In another example, the at least one coil of the coil unit is electrically connected to a power cable. The lateral wall includes an inner face having a notch. A driving circuit is received in the notch. The power cable extends along the metal housing base into the notch and is electrically connected to the driving circuit.

The lateral wall can be a plastic wall integrally wrapping an outer periphery of the metal housing base.

The shaft seat includes a face facing the closure member and defining a shaft seat reference face. The at least one coil of the coil unit has a top face flush with or below the shaft seat reference face.

The metal housing base includes the through-hole having a serrated inner periphery or includes at least one smaller through-hole adjacent to the through-hole.

In an example, the engagement face corresponds to the area of the permanent magnet in an axial direction of the shaft.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
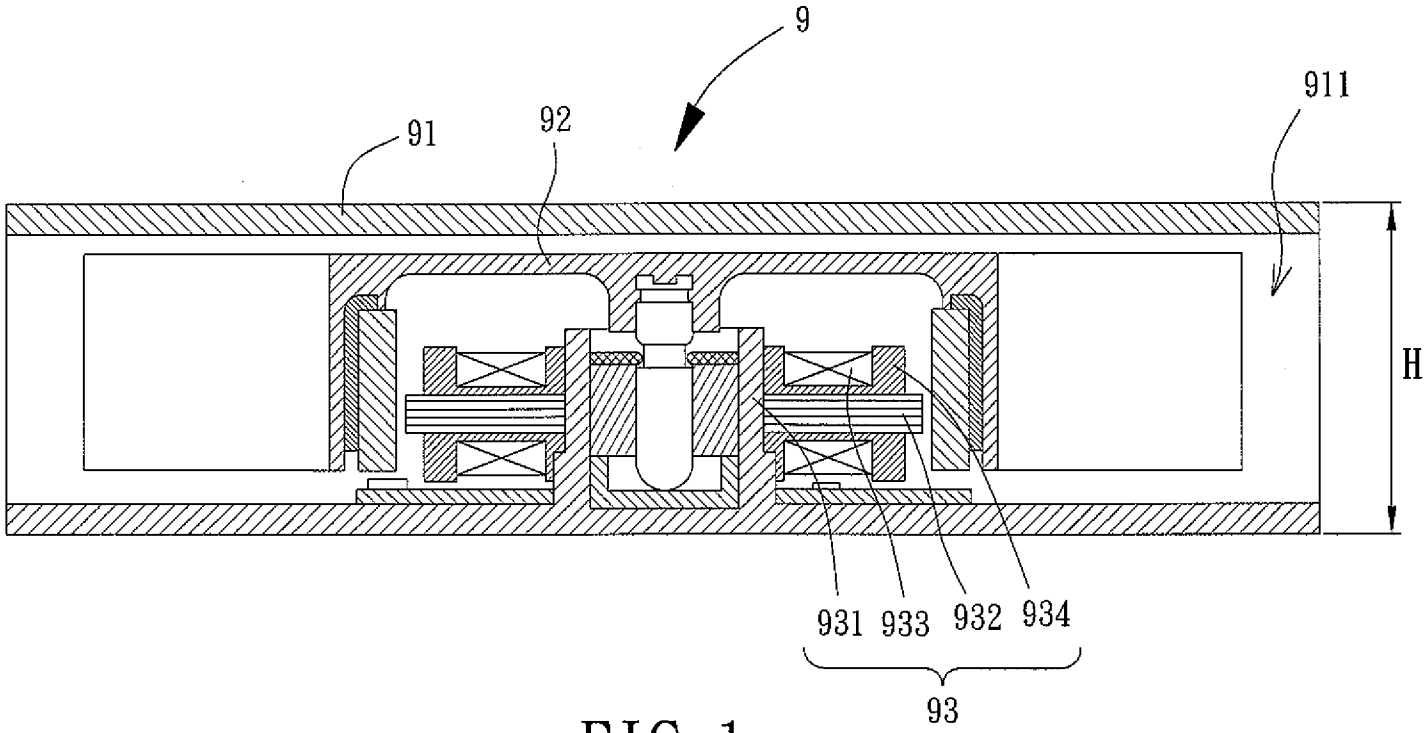
FIG. 1 PRIOR ART
FIG. 1 shows a cross sectional view of a conventional advection fan.
Figure 2:
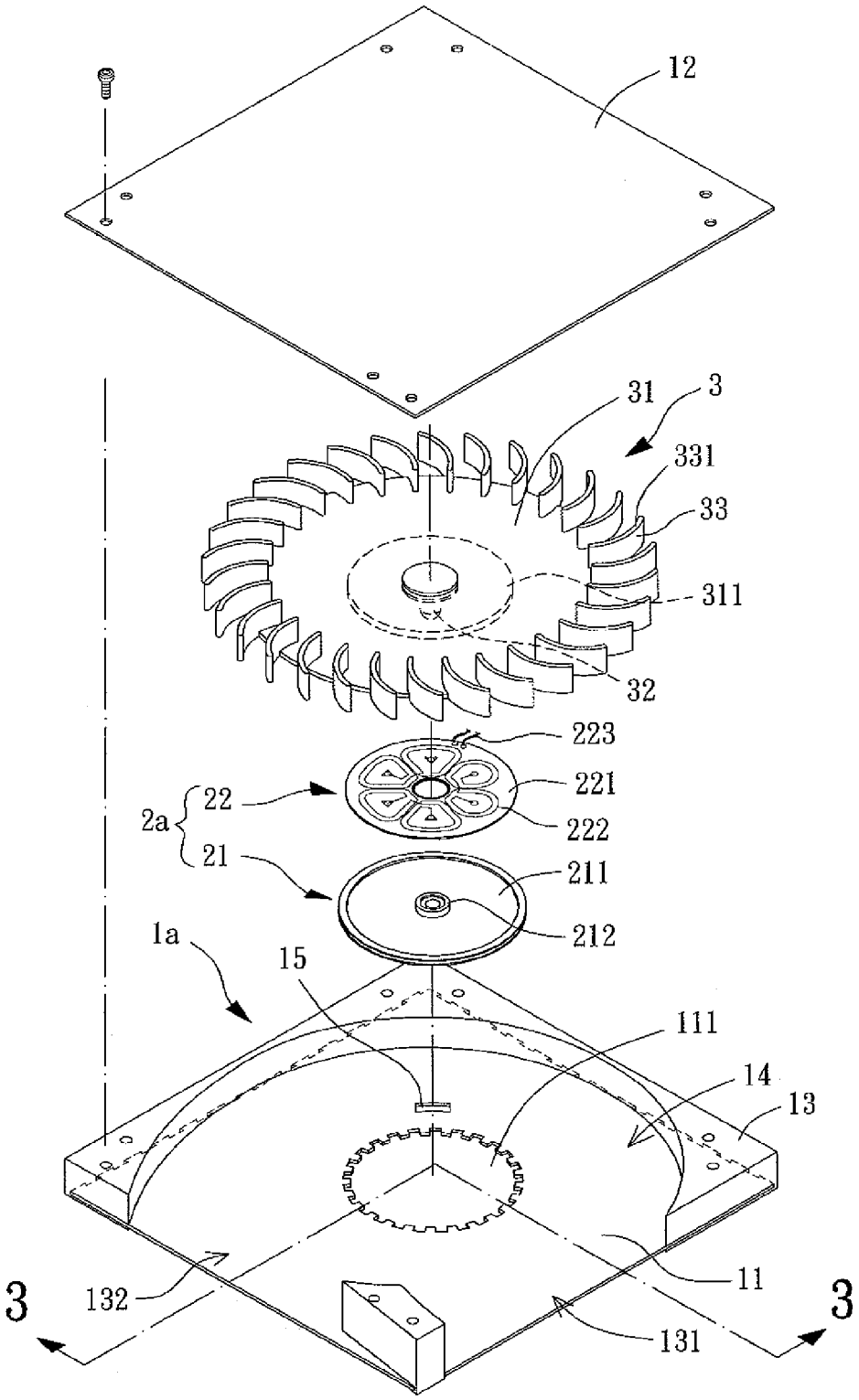
FIG. 2 shows an exploded, perspective view of an advection fan of a first embodiment according to the present invention.
Figure 3:
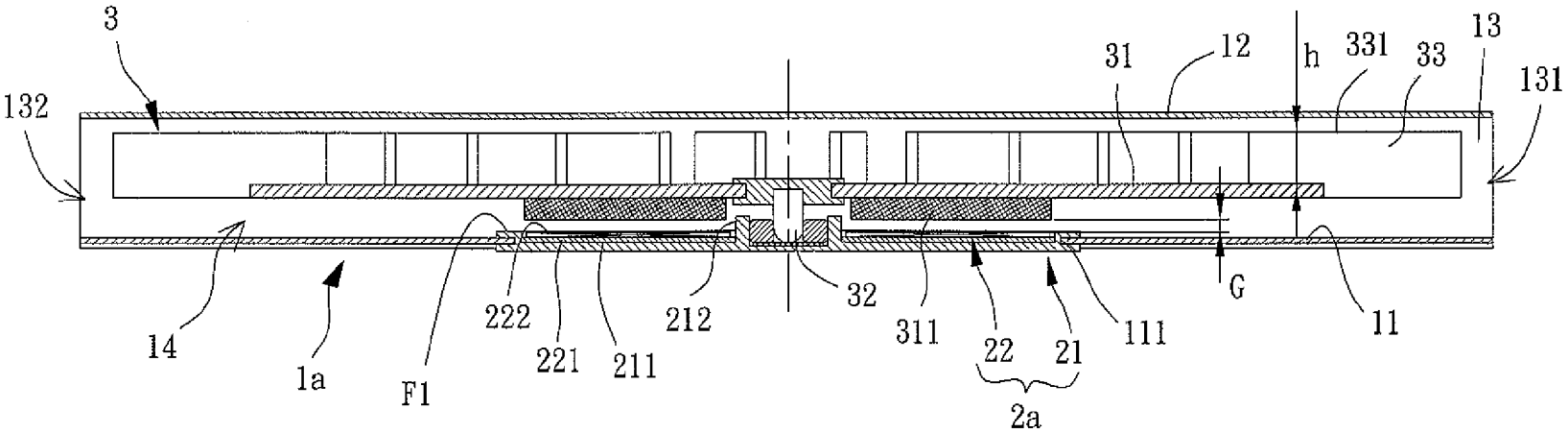
FIG. 3 shows a cross sectional view of the advection fan of the first embodiment observed at line 3-3 in FIG. 2.

An advection fan of a first embodiment according to the present invention is shown in FIGS. 2 and 3 and includes a housing 1*a*, a stator 2*a*, and an impeller 3. The housing 1*a* is configured to allow air currents to flow in a radial direction. The stator 2*a* is mounted to the housing 1*a*. The impeller 3 is rotatably coupled to the stator 2*a* and can be driven by the stator 2*a* to rotate.

The housing 1*a* can be any hollow frame that receives the stator 2*a* and the impeller 3 and that guides air currents in and out in the radial direction. The housing 1*a* can be of any geometric shape, such as polygonal, cylindrical, or elliptic. In this embodiment, the housing 1*a* is rectangular in a top view thereof.

The housing 1*a* includes a metal housing base 11 and a closure member 12 spaced from the metal housing base 11 in an axial direction. A lateral wall 13 is provided between the metal housing base 11 and the closure member 12 and includes an air inlet 131 and an air outlet 132 spaced from the air inlet 131 in a horizontal direction (as viewed from the drawings) that is perpendicular to the axial direction, forming a housing structure allowing air currents to flow in the horizontal direction. The housing structure is closed in the upper and lower ends (as viewed from the drawings), forming a horizontal air passage 14 between the metal housing base 11 and the closure member 12. The number and locations of the air inlet 131 and the air outlet 132 can be varied according to needs. The engagement and formation of the metal housing base 11, the closure member 12, and the lateral wall 13 are not limited. In this embodiment, the lateral wall 13 is formed by injection molding and wraps an outer periphery of the metal housing base 11, and the closure member 12 is in the form of a cover detachably mounted to the lateral wall 13.

The metal housing base 11 further includes an engagement section that can be any structure allowing embedding or abutment/attachment of the stator 2*a*. In this embodiment, the engagement section includes a through-hole 111 extending through the metal housing base 11. Preferably, the through-hole 111 includes a serrated inner periphery (FIG. 2). In another example, the metal housing base 11 includes at least one smaller through-hole adjacent to the through-hole 111 to allow engagement with the stator 2*a*, so that the stator 2*a* can be more reliably engaged in the through-hole 111 of the metal housing base 11. Furthermore, the metal housing base 11 preferably includes a wire hole 15 for electrical connection with the stator 2*a*, which will be described in detail later.

The stator 2*a* includes a shaft seat 21 and a coil unit 22. The shaft seat 21 includes a compartment 211 in which a shaft coupling portion 212 is mounted. The shaft coupling portion 212 can be any structure for coupling with the impeller 3 to allow smooth rotation of the impeller 3. The coil unit 22 is embedded in the compartment 211 and includes a substrate 221. At least one coil 222 is formed on a surface of the substrate 221 by a printing circuit or electroforming process. The coil 222 is electrically connected to a driving circuit (not shown) that can be directly mounted on the substrate 221. However, the driving circuit can be mounted in other locations of the housing 1*a* or outside of the housing 1*a*. In this embodiment, the coil 222 is connected by a power cable 223 to the driving circuit. An end of the power cable 223 preferably extends through the wire hole 15 to the driving circuit. By such an arrangement, the power cable 223 can extend outside of the housing la and, thus, will not occupy much of the air guiding space of the air passage 14, avoiding the air currents from being hindered by the power cable 223.

Preferably, the shaft seat 21 is made of plastic material, and the shaft seat 21 wraps and engages with the inner periphery of the through-hole 111 (the engagement section) of the metal housing base 11 by injection molding. Loosening of the shaft seat 21 can be effectively avoided if the inner periphery of the through-hole 111 is serrated (FIG. 2) or one or more smaller through-holes are formed adjacent to the through-hole 111. With reference to FIG. 3, a face of the shaft seat 21 facing the closure member 12 is defined as a shaft seat reference face "F1." By embedding the coil unit 22 in the compartment 211, a top face of the coil 222 of the coil unit 22 facing the closure member 12 is preferably flush with or below the shaft seat reference face "F1." Thus, only a portion of the shaft coupling portion 212 of the stator 2*a* is located in the air passage 14, avoiding the stator 2*a* from occupying much of the air guiding space of the air passage 14. As a result, the air passage 14 has a sufficient air guiding space for guiding air currents.

The impeller 3 is rotatably coupled to the shaft seat 21 of the stator 2*a*. The impeller 3 can be of any type. In this embodiment, an axial gap "G" is formed between the impeller 3 and the stator 2*a*. Compared to conventional advection fans using a radial air gap for driving purposes, the advection fan according to the present invention can effectively reduce the overall volume and structural complexity by using the axial gap "G" for driving purposes, further reducing the volume and the axial height of the impeller 3. In this embodiment, the impeller 3 includes a metal impeller base 31, a shaft 32, and a plurality of vanes 33. A permanent magnet 311 is mounted to the metal impeller base 31. With reference to FIG. 3, the permanent magnet 311 faces and is spaced from the coil unit 22 in the axial direction to form the axial gap "G." The metal impeller base 31 serves as a magnetism sealing board. The shaft 32 is coupled to a central portion of the metal impeller base 31 and rotatably engaged with the shaft coupling portion 212 of the shaft seat 21. The vanes 33 are engaged with an outer periphery of the metal impeller base 31. Preferably, the vanes 33 are plastic to be integrally formed with the outer periphery of the metal impeller base 31. Each vane 33 includes a top edge 331 in the axial direction of the shaft 32, with the top edge 331 facing the closure member 12, and with an axial height difference "h" existing between the top edge 331 and the metal impeller base 31. By providing the axial height difference "h," the air currents driven by the impeller 3 in the horizontal direction can pass above the metal impeller base 31 without hindrance. Thus, the impeller 3 can more smoothly guide air currents to flow through the interior of the housing 1*a* by utilizing the horizontal air guiding space, reducing the noise resulting from turbulence and significantly increasing the cooling effect.

In use of the advection fan according to the present invention, the coil 222 of the coil unit 22 of the stator 2*a* creates an alternating magnetic field that cooperates with the permanent magnet 311 to drive the impeller 3 to rotate. Thus, the advection fan according to the present invention can be used in various electronic products, with the vanes 33 guiding ambient air currents into the interior of the housing 1*a* via the air inlet 131 and then exiting from the air outlet 132 to the outside, providing the desired cooling effect for the heat sources generated during operation of the electronic products.

The first embodiment of the advection fan according to the present invention includes many features. Firstly, the metal housing base 11 of the housing 1*a* can be made of a thin metal sheet providing certain strength. Thus, the structural strength of the fan housing 1*a* still meets the standards for strength, although the housing 1*a* is thin. Furthermore, the coil 222 of the stator 2*a*can be formed on the surface of the substrate 221 by a printing circuit or electroforming process to further reduce the axial height of the stator 2*a*. Since the stator 2*a* is engaged with the through-hole 111 (the engagement section) and since the coil unit 22 of the stator 2*a* is embedded in the compartment 211, only the shaft coupling portion 212 of the stator 2*a* is located in the air passage 14. Overall, by the structural arrangement of the housing 1*a* and the stator 2*a* according to the present invention, the stator 2*a* will not occupy much space in the air passage 14, such that the air guiding space of the air passage 14 can be effectively used. When the impeller 3 guides the air currents to flow through the air passage 14, the air output and the wind pressure of the impeller 3 can be increased while effectively reducing the hindrance to the air currents by the stator 2*a*, avoiding unnecessary noise. Further, the axial height of the advection fan according to the present invention can be reduced effectively, allowing development and research in miniaturization.

Figure 4:
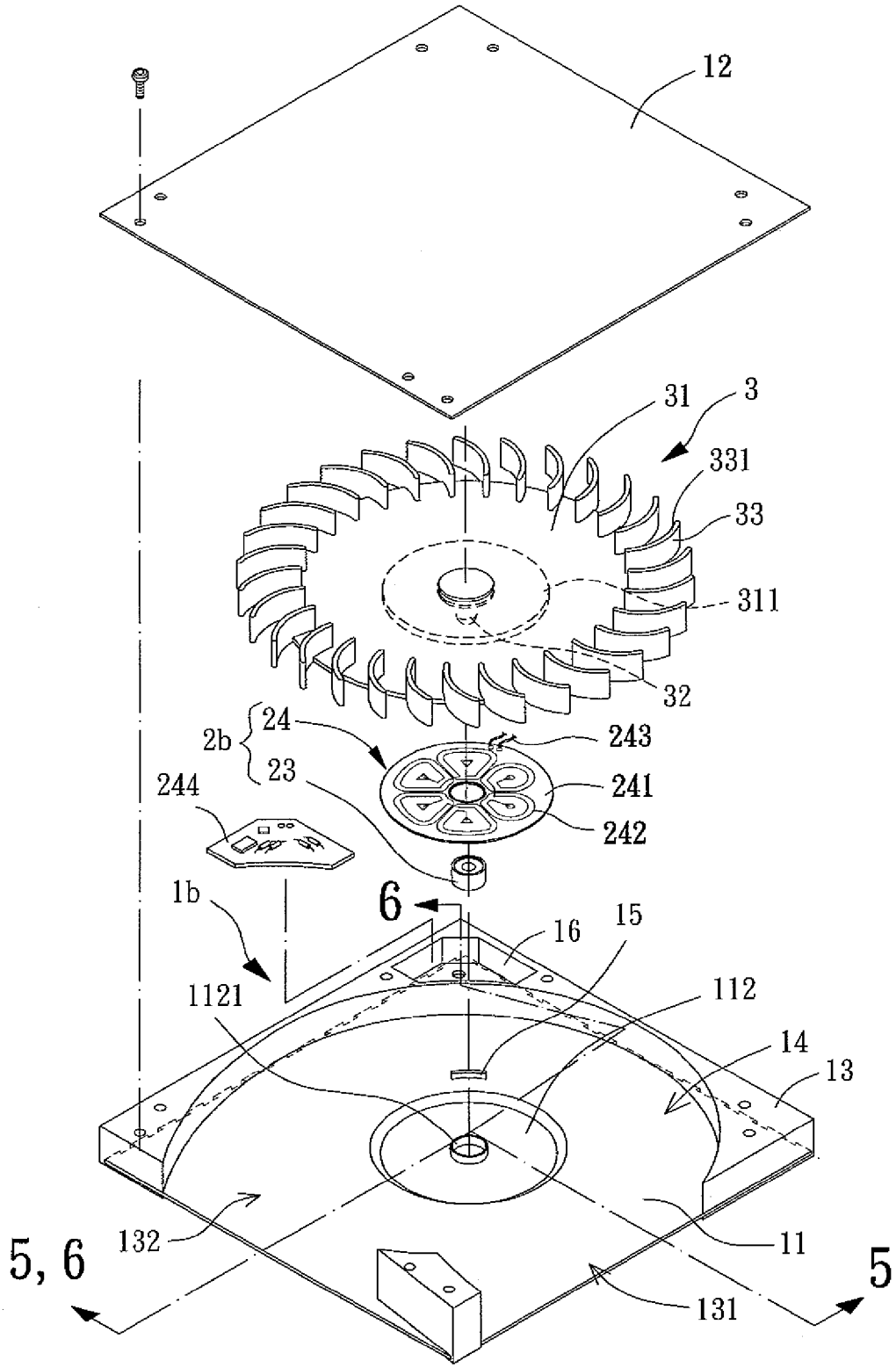
FIG. 4 shows an exploded, perspective view of an advection fan of a second embodiment according to the present invention.
Figure 5:
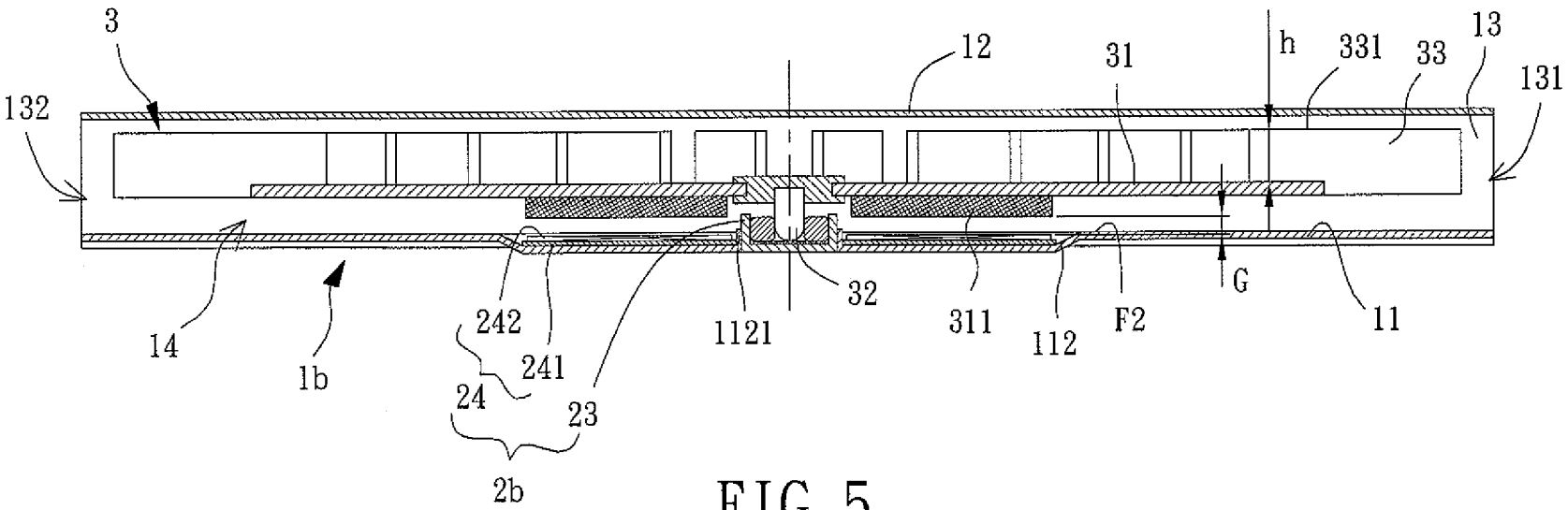
FIG. 5 shows a cross sectional view of the advection fan of the second embodiment observed at line 5-5 in FIG. 4.

FIGS. 4 and 5 show an advection fan of a second embodiment according to the present invention. Similar to the first embodiment, the second embodiment includes a housing 1*b*, a stator 2*b*, and an impeller 3. The housing 1*b* is substantially the same as the housing 1*a* and includes a metal housing base 11, a closure member 12, a lateral wall 13, an air inlet 131, an air outlet 132, an air passage 14, and a wire hole 15. The structural features of the housing 1*b* and the impeller 3 of the second embodiment identical to those of the housing 1*a* and the impeller 3 will not be described in detail to avoid redundancy.

The difference between the housing 1*b* of the second embodiment and the housing 1*a* of the first embodiment is that the engagement section of the metal housing base 11 of the housing 1*b* for coupling with the stator 2*b* (by embedding or abutment/attachment) is in the form of a recess 112 formed in the surface of the metal housing base 11 by punching. The recess 112 includes a bottom having a fixing hole 1121 in a center thereof. The lateral wall 13 includes a receiving portion 16 to cooperate with the wire hole 15. In an example shown in FIGS. 4 and 6, the receiving portion 16 is in the form of a cavity defined in a top side of the lateral wall 13. In another example shown in FIGS. 7 and 8, the receiving portion 16 is in the form of a cavity defined in a bottom side of the lateral wall 13. The receiving portion 16 can receive a driving circuit or the like.

The stator 2*b* of the second embodiment is embedded in the recess 112 of the metal housing base 11. The stator 2*b* includes a shaft tube 23 and a coil unit 24. An end of the shaft tube 23 is fixed in the fixing hole 1121 of the recess 112. The shaft 32 of the impeller 3 is rotatably coupled to the other end of the shaft tube 23. The shaft tube 23 can be fixed in the fixing hole 1121 by tight fitting, welding, male/female coupling, thread engagement, etc. The coil unit 24 is embedded in the recess 112 of the metal housing base 11 and includes a substrate 241 that has at least one coil 242 formed on a surface of the substrate 241 by a printing circuit or electroforming process.

Figure 6:
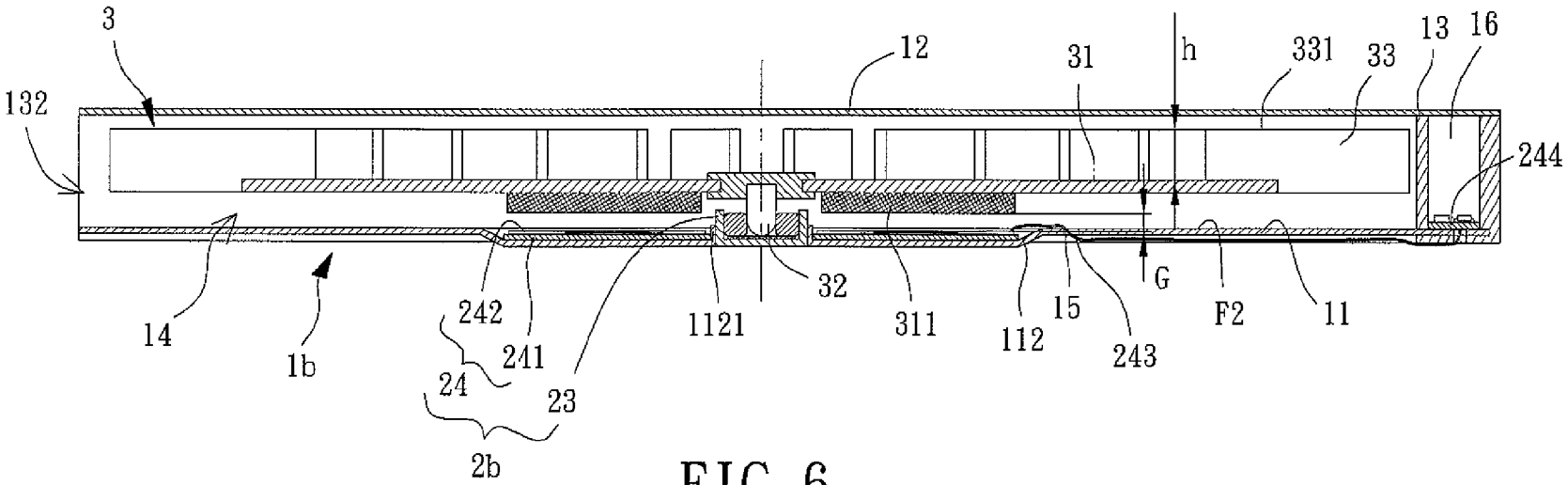
FIG. 6 shows another cross sectional view of the advection fan of the second embodiment observed at line 6-6 in FIG. 4.

In the example shown in FIG. 6 in which the receiving portion 16 is a cavity defined in the top side of the lateral wall 13, the coil 242 can be connected by a power cable 243 to a driving circuit 244 that is received in the receiving portion 16 of the housing 1*b*. An end of the power cable 243 preferably extends through the wire hole 15 of the metal housing base 11 of the housing 1*b* and extends along a bottom side of the housing 1*b* into the receiving portion 16 to connect the driving circuit 244. By such an arrangement, the power cable 243 will not occupy much of the air guiding space of the air passage 14, avoiding hindrance to the air currents by the power cable 243. With the driving circuit 244 received in the receiving portion 16, the limited space of the housing 1*b* can be used more effectively.

Figure 7:
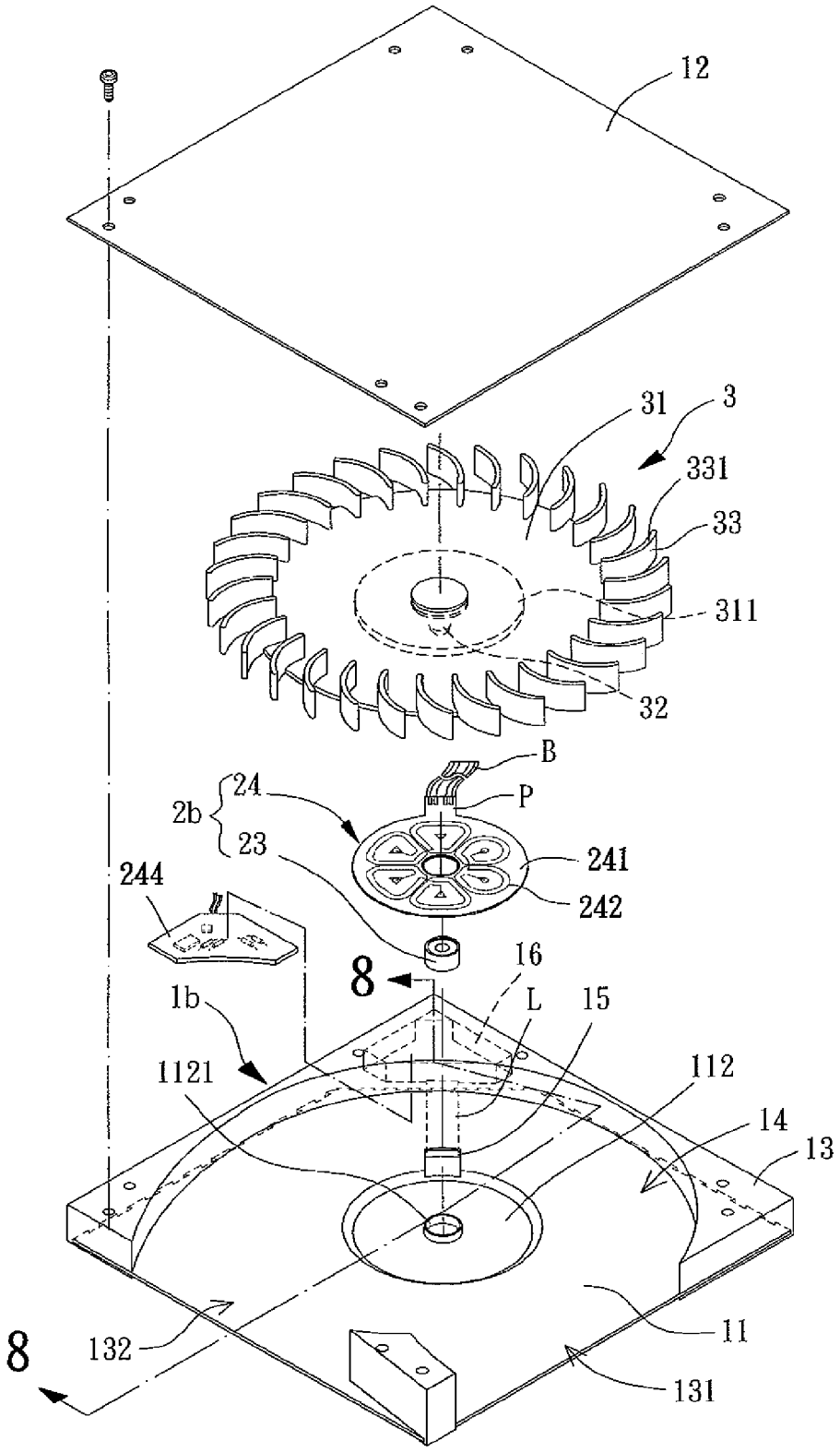
FIG. 7 shows an exploded, perspective view of another example of the advection fan of the second embodiment according to the present invention.
Figure 8:
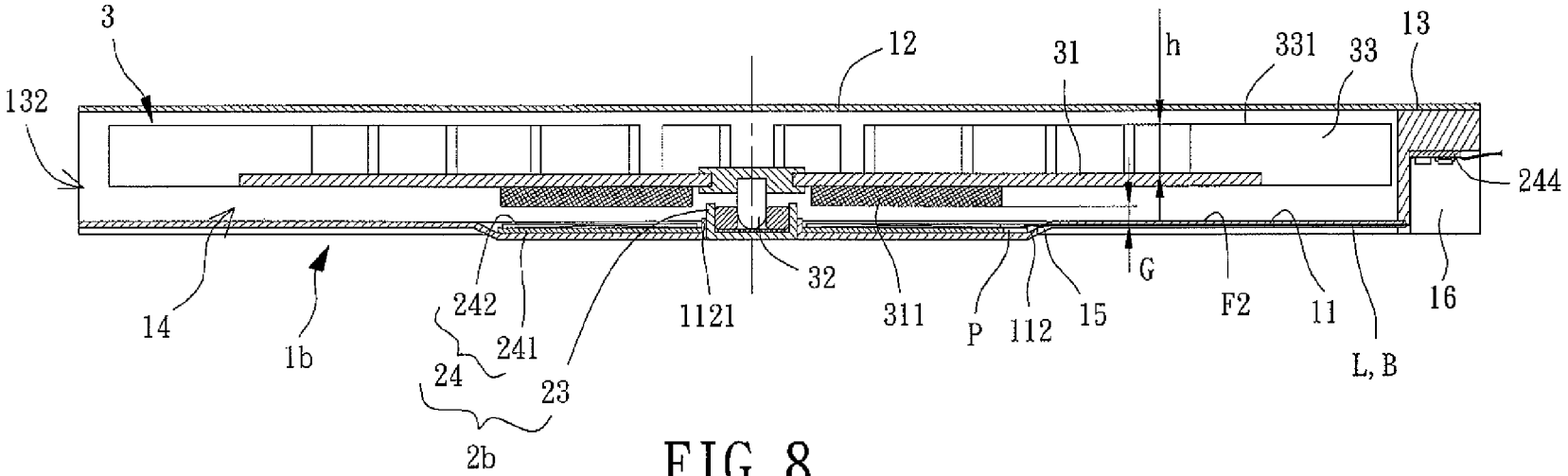
FIG. 8 shows a cross sectional view of the advection fan of the second embodiment observed at line 8-8 in FIG. 7.

In the example shown in FIGS. 7 and 8 in which the receiving portion 16 is a cavity defined in the bottom side of the lateral wall 13, the bottom side of the metal housing base 11 of the housing 1*b* can include a wire groove "L" extending between the wire hole 15 and the receiving portion 16 and receiving a flexible flat cable "B." Thus, the power cable 243 in FIG. 6 is not necessary. The substrate 241 of the stator 2*b* includes a port "P" electrically connected to the coil 242 and extending out of the wire hole 15. The driving circuit 244 is received in the receiving portion 16 and electrically connected by the flexible flat cable "B" to the port "P." The flexible flat cable "B" can be detachably attached to or integrally formed with the driving circuit 244.

With reference to FIG. 5, a face of the metal housing base 11 facing the closure member 12 is defined as a base reference face "F2." By embedding the coil unit 24 in the recess 112 of the metal housing base 11, a top face of the coil 242 facing the closure member 12 is preferably flush with or below the base reference face "F2." Thus, only the other end of the stator 2*b* having the shaft tube 23 is located in the air passage 14, avoiding the stator 2*b* from occupying too much of the air guiding space of the air passage 14.

The second embodiment of the advection fan according to the present invention includes many features. Firstly, the metal housing base 11 of the housing 1*b* can be made of a thin metal sheet providing a certain strength. Furthermore, the coil 242 of the stator 2*b* can be formed on the surface of the substrate 241 by a printing circuit or electroforming process to further reduce the axial height of the stator 2*b*. Since the stator 2*b* is embedded in the recess 112 of the metal housing base 11, only the other end of the stator 2*b* having the shaft tube 23 is located in the air passage 14. Overall, by the structural arrangement of the housing lb and the stator 2*b* according to the present invention, the stator 2*b* will not occupy much space in the air passage 14, such that the air guiding space of the air passage 14 can be effectively used, increasing the air output and the wind pressure of the impeller 3. Unnecessary noise and the axial height of the advection fan can effectively be reduced, allowing development and research in miniaturization.

Figure 9:
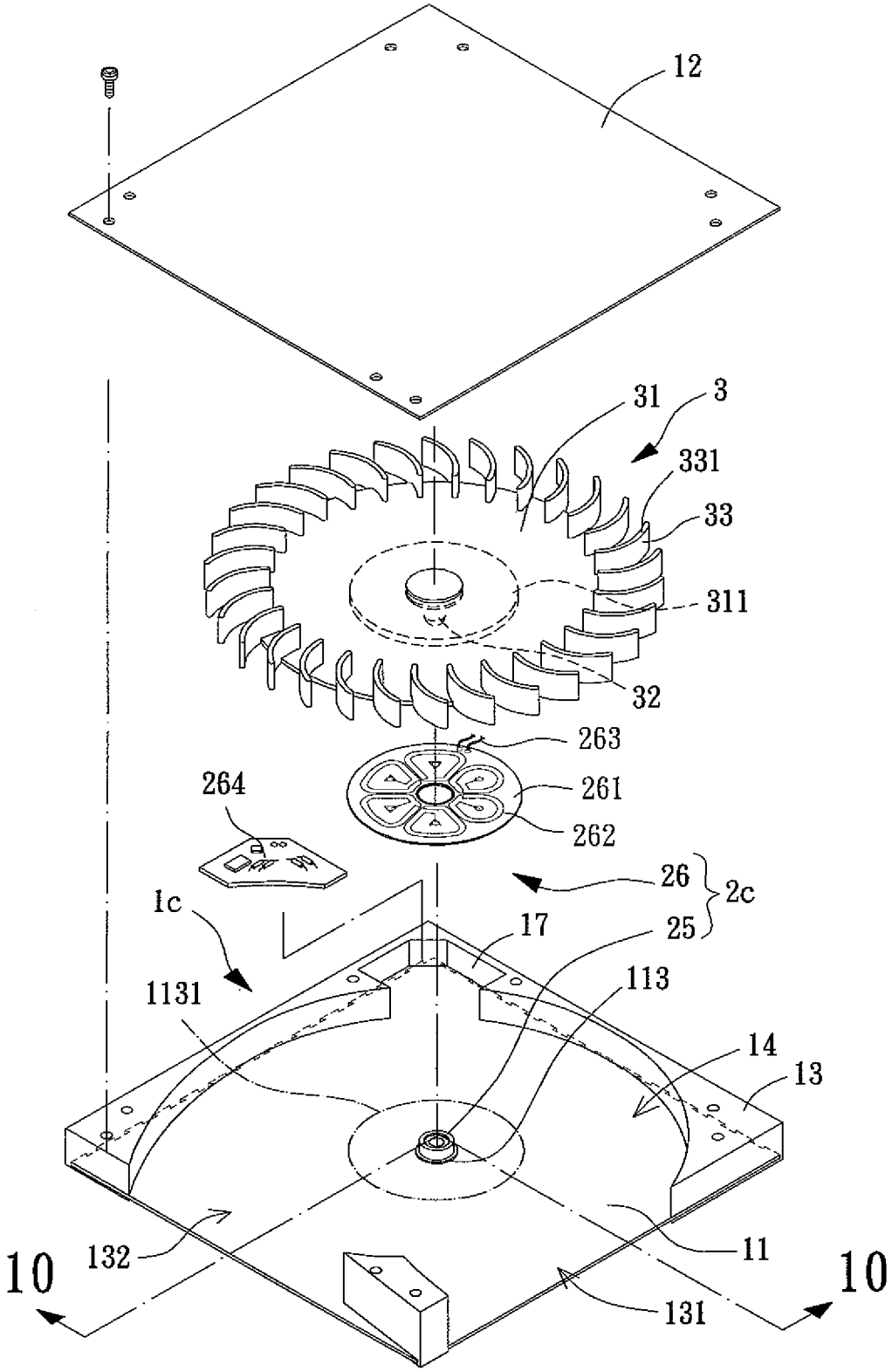
FIG. 9 shows an exploded, perspective view of an advection fan of a third embodiment according to the present invention.
Figure 10:
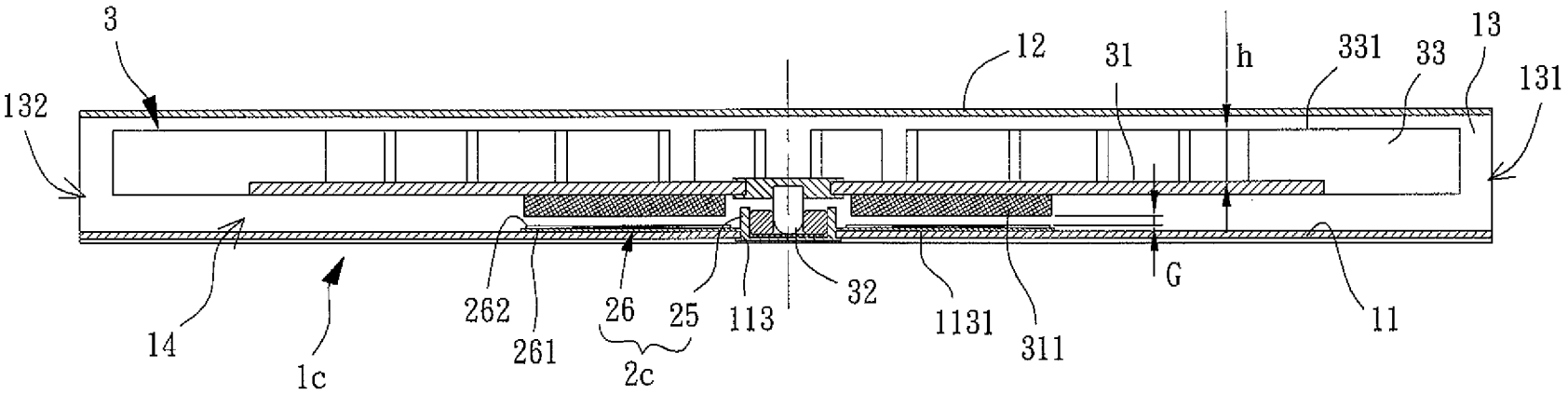
FIG. 10 shows a cross sectional view of the advection fan of the second embodiment observed at line 10-10 in FIG. 9.

FIGS. 9 and 10 show an advection fan of a third embodiment according to the present invention. Similar to the first embodiment, the third embodiment includes a housing 1*c*, a stator 2*c*, and an impeller 3. The housing 1*c* is substantially the same as the housing 1*a* and includes a metal housing base 11, a closure member 12, a lateral wall 13, an air inlet 131, an air outlet 132, and an air passage 14. The structural features of the housing 1*c* and the impeller 3 of the third embodiment identical to those of the housing 1*a* and the impeller 3 will not be described in detail to avoid redundancy.

The difference between the housing 1*c* of the third embodiment and the housing 1*a* of the first embodiment is that the engagement section of the metal housing base 11 of the housing 1*c* for coupling with the stator 2*c* by abutment/attachment includes a shaft receiving hole 113 and an engagement face 1131 surrounding the shaft receiving hole 113. Preferably, the engagement face 1131 corresponds to the area of the permanent magnet 311. Preferably, the lateral wall 13 includes an inner face having a notch 17 for receiving a driving circuit or the like, which will be described in detail later.

The stator 2*c* of the third embodiment is attached to and abuts the engagement section (including the shaft receiving hole 113 and the engagement face 1131) of the metal housing base 11. The stator 2*c* includes a shaft tube 25 and a coil unit 26. An end of the shaft tube 25 is fixed in the shaft receiving hole 113. The shaft 32 of the impeller 3 is rotatably coupled to the other end of the shaft tube 25. The shaft tube 25 can be fixed in the shaft receiving hole 113 by tight fitting, welding, male/female coupling, thread engagement, etc. In this embodiment, the shaft tube 25 is formed by injection molding and wraps the inner periphery of the shaft receiving hole 113, thereby engaging with the shaft receiving hole 113. The coil unit 26 abuts the engagement face 1131 of the metal housing base 11. The coil unit 26 includes a substrate 261, with at least one coil 262 formed on a surface of the substrate 261 by a printing circuit or electroforming process. In this embodiment, the coil 262 is connected by a power cable 263 to a driving circuit 264 that is received in the notch 17 of the housing 1*c*. With reference to FIG. 9, the housing 1*c* of this embodiment does not have to include the wire hole 15 in the first and second embodiments. Instead, the power cable 263 abuts the surface of the metal housing base 11 and extends into the notch 17, allowing easy connection to the driving circuit 264 in assembly. With the driving circuit 264 received in the notch 17, the limited space of the housing 1*c* can effectively be used.

The third embodiment of the advection fan according to the present invention includes many features. Firstly, the metal housing base 11 of the housing 1*c* can be made of a thin metal sheet providing a certain strength. Furthermore, the coil 262 of the stator 2*c* can be formed on the surface of the substrate 261 by a printing circuit or electroforming process to further reduce the axial height of the stator 2*c*. Since the stator 2*c* is engaged with the engagement section (including the shaft receiving hole 113 and the engagement face 1131) of the metal housing base 11, only the other end of the stator 2*c* having the shaft tube 25 is located in the air passage 14.

Overall, by the structural arrangement of the housing 1*c* and the stator 2*c* according to the present invention, the stator 2*c* will not occupy much space in the air passage 14 such that the air guiding space of the air passage 14 can be effectively used, increasing the air output and the wind pressure of the impeller 3. Unnecessary noise and the axial height of the advection fan can effectively be reduced, allowing development and research in miniaturization.

Conclusively, the advection fans of the present invention provide many advantages based on the structural designs of the advection fans of the first, second, and third embodiments.

1. The Space in the Air Passage 14 can Effectively be Utilized.

When using the advection fans according to the present invention in small electronic products, the volume and the axial height of the housing 1*a*, 1*b*, 1*c* are miniaturized. Since the stator 2*a*, 2*b*, 2*c* is embedded or attached to and abuts the engagement section of the thin metal housing base 11 and since the coil 222, 242, 262 of the stator 2*a*, 2*b*, 2*c* is formed on a surface of the substrate 221, 241, 261 by a printing circuit or electroforming process, the volume and the axial height of the stator 2*a*, 2*b*, 2*c* can be further reduced. More specifically, only the shaft coupling portion 212 or the shaft tube 23, 25 of the stator 2*a*, 2*b*, 2*c* according to the present invention is located in the air passage 14, such that the stator 2*a*, 2*b*, 2*c* does not occupy much space in the air passage 14. Compared to, conventional advection fans having a horizontal air passage, the present invention can effectively increase the air guiding space of the air passage 14, increase the air output and the wind pressure, and reduce noise.

2. Development and Research in Miniaturization.

Since the stator 2*a*, 2*b*, 2*c* does not occupy much space in the air passage 14, the housing 1*a*, 1*b*, 1*c* does not have to increase the space for receiving the stator 2*a*, 2*b*, 2*c*. Namely, the housing 1*a*, 1*b*, 1*c* according to the present invention can be easily reduced in the volume and the axial height, allowing development and research in miniaturization.

3. Excellent Cooling Effect.

Since the stator 2*a*, 2*b*, 2*c* according to the present invention as a whole is relatively thin, the impeller 3 of the advection fan according to the present invention does not have to be in the form of a hub for receiving the stator 2*a*, 2*b*, 2*c*. Thus, when the impeller 3 is guiding air currents to flow through the air passage to provide convection, the air currents will not be hindered by the impeller 3, avoiding turbulence and increasing the cooling effect. Furthermore, in the case that the metal impeller base 31 of the impeller 3 is coupled with the shaft 32 and the vanes 33 as shown in the previous embodiments, the reduction of turbulence and increase of the cooling effect are more obvious during guiding of the air currents by the impeller 3 in the horizontal direction.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. An advection fan comprising:

a housing including a metal housing base and a closure member, with a lateral wall arranged between the metal housing base and the closure member and including an air inlet and an air outlet, with a horizontal air passage defined between the metal housing base and the closure member, with the metal housing base including an engagement section;

a stator including a shaft seat and a coil unit, with the shaft seat attached to the engagement section, with the shaft seat including a shaft coupling portion and a bottom wall extending radially outward of the shaft coupling portion to an outer rim extending axially from the bottom wall and terminating in a face facing the closure member, with the face of the outer rim defining a shaft seat reference face, with the shaft coupling portion, the bottom wall, and the outer rim defining a compartment, with the coil unit embedded in the compartment, with the coil unit including a substrate and at least one coil formed on a surface of the substrate, with the substrate intermediate the at least one coil and the bottom wall, with the at least one coil of the coil unit having a top face flush with or below the shaft seat reference face; and an impeller rotatably coupled to the shaft coupling portion of the shaft seat of the stator, with a gap formed between the impeller and the coil unit of the stator.

2. The advection fan as claimed in claim 1, with the engagement section including a through-hole, with the shaft seat integrally wrapping the through-hole of the metal housing base, with the at least one coil formed on the surface of the substrate by a printing circuit or electroforming process.

3. The advection fan as claimed in claim 1, with the impeller including a metal impeller base, a shaft, and a plurality of vanes, with the metal impeller base including a permanent magnet facing the coil unit, with the gap being an axial gap between the permanent magnet and the coil unit, with the shaft coupled to a central portion of the metal impeller base and rotatably coupled to the shaft coupling portion of the shaft seat, with the plurality of vanes engaged with the metal impeller base.

4. The advection fan as claimed in claim 3, with each of the plurality of vanes including a top edge extending radially to an axial direction of the shaft, with the top edge of each of the plurality of vanes facing the closure member, with an axial height difference existing between the top edge of each of the plurality of vanes and the metal impeller base.

5. The advection fan as claimed in claim 3, with the plurality of vanes being plastic vanes integrally formed with an outer periphery of the metal impeller base.

6. The advection fan as claimed in claim 1, with the metal housing base including a wire hole, with the at least one coil of the coil unit electrically connected to a power cable, with the power cable extending through the wire hole and electrically connected to a driving circuit.

7. The advection fan as claimed in claim 1, with the metal housing base including a wire hole, with the at least one coil of the coil unit electrically connected to a power cable, with the lateral wall including an inner face, an outer face opposite to the inner face, and a receiving portion extending from the inner face towards but spaced from the outer face and communicating with the horizontal air passage, with the receiving portion receiving a driving circuit, with the power cable extending through the wire hole and extending along a bottom side of the housing into the receiving portion and electrically connected to the driving circuit.

8. The advection fan as claimed in claim 7, with the receiving portion being a cavity defined in the lateral wall.

9. The advection fan as claimed in claim 1, with the at least one coil of the coil unit electrically connected to a power cable, with the lateral wall including an inner face, an outer face opposite to the inner face, and a notch extending from the inner face towards but spaced from the outer face and communicating with the horizontal air passage, with a driving circuit received in the notch, with the power cable extending along the metal housing base into the notch and electrically connected to the driving circuit.

10. The advection fan as claimed in claim 1, with the lateral wall being a plastic wall integrally wrapping an outer periphery of the metal housing base.

11. The advection fan as claimed in claim 2, with the metal housing base including the through-hole having a serrated inner periphery.

12. An advection fan comprising:

a housing including a metal housing base and a closure member, with a lateral wall arranged between the metal housing base and the closure member and including an air inlet and an air outlet with a horizontal air passage defined between the metal housing base and the closure member, with the metal housing base including an engagement section having a face facing the closure member and defining a base reference face and a recess, with the recess including a bottom having a fixing hole, with the base reference face being intermediate the bottom of the recess and the closure member;

a stator including a shaft tube and a coil unit, with the shaft tube fixed in the fixing hole of the recess, with the coil unit embedded in the recess, with the coil unit including a substrate and at least one coil formed on a surface of the substrate, with the at least one coil of the coil unit having a top face flush with or below the base reference face; and an impeller rotatably coupled to the shaft tube of the stator, with a gap formed between the impeller and the coil unit of the stator.

13. The advection fan as claimed in claim 12, with the impeller including a metal impeller base, a shaft, and a plurality of vanes, with the metal impeller base including a permanent magnet facing the coil unit, with the gap being an axial gap between the permanent magnet and the coil unit, with the shaft coupled to a central portion of the metal impeller base and rotatably coupled to the shaft tube, with the plurality of vanes engaged with the metal impeller base.

14. The advection fan as claimed in claim 13, with each of the plurality of vanes including a top edge extending radially to an axial direction of the shaft, with the top edge of each of the plurality of vanes facing the closure member, with an axial height difference existing between the top edge of each of the plurality of vanes and the metal impeller base.

15. The advection fan as claimed in claim 13, with the plurality of vanes being plastic vanes integrally formed with an outer periphery of the metal impeller base.

16. The advection fan as claimed in claim 12, with the metal housing base including a wire hole, with the at least one coil of the coil unit electrically connected to a power cable, with the power cable extending through the wire hole and electrically connected to a driving circuit.

17. The advection fan as claimed in claim 12, with the metal housing base including a wire hole, with the at least one coil of the coil unit electrically connected to a power cable, with the lateral wall including an inner face, an outer face opposite to the inner face, and a receiving portion extending from the inner face towards but spaced from the outer face and communicating with the horizontal air passage, with the receiving portion receiving a driving circuit, with the power cable extending through the wire hole and extending along a bottom side of the housing into the receiving portion and electrically connected to the driving circuit.

18. The advection fan as claimed in claim 17, with the receiving portion being a cavity defined in the lateral wall.

19. The advection fan as claimed in claim 12, with the at least one coil of the coil unit electrically connected to a power cable, with the lateral wall including an inner face, an outer face opposite to the inner face, and a notch extending from the inner face towards but spaced from the outer face and communicating with the horizontal air passage, with a driving circuit received in the notch, with the power cable extending along the metal housing base into the notch and electrically connected to the driving circuit.

20. The advection fan as claimed in claim 12, with the lateral wall being a plastic wall integrally wrapping an outer periphery of the metal housing base.

21. An advection fan comprising:

a housing including a metal housing base and a closure member, with a lateral wall arranged between the metal housing base and the closure member and including an inner face, an outer face opposite to the inner face, an air inlet and an air outlet, with a horizontal air passage defined by the inner face of the lateral wall between the metal housing base and the closure member, with the metal housing base including an engagement section, with the engagement section including a shaft receiving hole and an engagement face surrounding the shaft receiving hole;

a stator including a shaft tube and a coil unit, with the shaft tube fixed in the shaft receiving hole, with the coil unit embedded in the engagement face of the metal housing base, with the coil unit including a substrate and at least one coil formed on a surface of the substrate, with the at least one coil of the coil unit electrically connected to a power cable, with the inner face having a notch extending from the inner face towards but spaced from the outer surface and communicating with the horizontal air passage;

a driving circuit received in the notch, with the power cable extending along the metal housing base into the notch and electrically connected to the driving circuit; and an impeller rotatably coupled to the shaft tube of the stator, with a gap formed between the impeller and the coil unit of the stator.

22. The advection fan as claimed in claim 21, with the impeller including a metal impeller base, a shaft, and a plurality of vanes, with the metal impeller base including a permanent magnet facing the coil unit, with the gap being an axial gap between the permanent magnet and the coil unit, with the shaft coupled to a central portion of the metal impeller base and rotatably coupled to the shaft tube, with the plurality of vanes engaged with the metal impeller base.

23. The advection fan as claimed in claim 22, with each of the plurality of vanes including a top edge extending radially to an axial direction of the shaft, with the top edge of each of the plurality of vanes facing the closure member, with an axial height difference existing between the top edge of each of the plurality of vanes and the metal impeller base.

24. The advection fan as claimed in claim 22, with the plurality of vanes being plastic vanes integrally formed with an outer periphery of the metal impeller base.

25. The advection fan as claimed in claim 21, with the lateral wall being a plastic wall integrally wrapping an outer periphery of the metal housing base.

26. The advection fan as claimed in claim 22, with the engagement face corresponding to an area of the permanent magnet in an axial direction of the shaft.

27. An advection fan comprising:

a housing including a metal housing base and a closure member, with a lateral wall arranged between the metal housing base and the closure member and including an inner face, an outer face opposite to the inner face, an air inlet and an air outlet, with a horizontal air passage defined by the inner face of the lateral wall between the metal housing base and the closure member, with the metal housing base including an engagement section, with the metal housing base including a wire hole, with the lateral wall including a receiving portion extending from the inner face towards but spaced from the outer face and communicating with the horizontal air passage, with the receiving portion being a cavity defined in the lateral wall;

a stator including a coil unit embedded in the engagement section of the metal housing base, with the coil unit abutting the engagement face of the metal housing base, with the coil unit including a substrate and at least one coil formed on a surface of the substrate, with the at least one coil of the coil unit electrically connected to a power cable;

a driving circuit received in the cavity, with the power cable extending through the wire hole and extending along a bottom side of the housing into the receiving portion and electrically connected to the driving circuit; and an impeller rotatably coupled to the shaft tube of the stator, with a gap formed between the impeller and the coil unit of the stator.

28. The advection fan as claimed in claim 27, with the impeller including a metal impeller base, a shaft, and a plurality of vanes, with the metal impeller base including a permanent magnet facing the coil unit, with the gap being an axial gap between the permanent magnet and the coil unit, with the shaft coupled to a central portion of the metal impeller base and rotatably coupled to the stator, with the plurality of vanes engaged with the metal impeller base.

29. The advection fan as claimed in claim 28, with each of the plurality of vanes including a top edge extending radially to an axial direction of the shaft, with the top edge of each of the plurality of vanes facing the closure member, with an axial height difference existing between the top edge of each of the plurality of vanes and the metal impeller base.

30. The advection fan as claimed in claim 28, with the plurality of vanes being plastic vanes integrally formed with an outer periphery of the metal impeller base.

31. The advection fan as claimed in claim 27, with the lateral wall being a plastic wall integrally wrapping an outer periphery of the metal housing base.

32. The advection fan as claimed in claim 27, with the metal housing base including an engagement section having a face facing the closure member and defining a base reference face and a recess, with the recess including a bottom having a fixing hole, with the base reference face being intermediate the bottom of the recess and the, closure member, with the at least one coil of the coil unit having a top face flush with or below the base reference face.

33. An advection fan comprising:

a housing including a metal housing base and a closure member, with a lateral wall arranged between the metal housing base and the closure member and including an inner face, an outer face opposite to the inner face, an air inlet and an air outlet, with a horizontal air passage defined by the inner face of the lateral wall between the metal housing base and the closure member, with the metal housing base including an engagement section;

a stator including a coil unit embedded in the engagement section of the metal housing base, with the coil unit abutting the engagement face of the metal housing base, with the coil unit including a substrate and at least one coil formed on a surface of the substrate, with the at least one coil of the coil unit electrically connected to a power cable, with the inner face having a notch extending from the inner face towards but spaced from the outer face and communicating with the horizontal air passage;

a driving circuit received in the notch, with She power cable extending along the metal housing base into the notch and electrically connected to the driving circuit; and an impeller rotatably coupled to the shaft tube of the stator, with a gap formed between the impeller and the coil unit of the stator.

34. The advection fan as claimed in claim 33, with the engagement section including a through-hole, with the shaft seat integrally wrapping the through-hole of the metal housing base, with the at least one coil formed on the surface of the substrate by a printing circuit or electroforming process.

* * * * *